US005567124A

United States Patent [19]

Takenaka et al.

[11] Patent Number: 5,567,124

[45] Date of Patent: Oct. 22, 1996

[54] VARIABLE CAPACITY SWASH-PLATE TYPE COMPRESSOR WITH AN IMPROVED CAPACITY CONTROL MEANS

[75] Inventors: Kenji Takenaka; Hiroaki Kayukawa; Shigeyuki Hidaka, all of Kariya, Japan

[73] Assignee: Kabushiki Kaisha Toyoda Jidoshokki Seisakusho, Aichi, Japan

[21] Appl. No.: 168,773

[22] Filed: Dec. 16, 1993

[30] Foreign Application Priority Data

Dec. 21, 1992 [JP] Japan ..... 4-340276

[51] Int. Cl.[6] ..... F04B 1/29

[52] U.S. Cl. ..... 417/222.2

[58] Field of Search ..... 417/222.1, 222.2, 417/270, 269

[56] References Cited

U.S. PATENT DOCUMENTS

| | | | |
|---|---|---|---|
| 3,861,829 | 1/1975 | Roberts et al. | 417/53 |
| 4,428,718 | 1/1984 | Skinner | 417/222 |
| 4,606,705 | 8/1986 | Parekh | 417/222.2 |
| 4,685,866 | 8/1987 | Takenaka et al. | 417/222.2 |
| 4,688,997 | 8/1987 | Suzuki et al. | 417/222.2 |
| 4,752,189 | 6/1988 | Bearint | 417/222.2 |
| 4,842,488 | 6/1989 | Terauchi | 417/222.2 |
| 5,071,321 | 12/1991 | Skinner et al. | 417/222.2 |
| 5,165,863 | 11/1992 | Taguchi | 417/222.2 |
| 5,174,727 | 12/1992 | Terauchi et al. | 417/222.1 |
| 5,242,274 | 9/1993 | Inoue | 417/222.2 |
| 5,286,172 | 2/1994 | Taguchi | 417/222.2 |
| 5,318,410 | 6/1994 | Kawamura et al. | 417/222.2 |
| 5,332,365 | 7/1994 | Taguchi | 417/222.2 |
| 5,380,161 | 11/1995 | Takenaka | 417/269 |

FOREIGN PATENT DOCUMENTS

| | | | |
|---|---|---|---|
| 1142277 | 6/1969 | Japan . | |
| 61-279787 | 12/1986 | Japan . | |
| 3294668 | 12/1991 | Japan | 417/222.2 |

*Primary Examiner*—Peter Korytnyk

*Attorney, Agent, or Firm*—Burgess, Ryan and Wayne

[57] ABSTRACT

A variable capacity swash-plate type compressor provided with a suction chamber for refrigerant gas before compression, a discharge chamber for compressed refrigerant gas, a crank chamber for a swash-plate assembly driving reciprocation of compressing pistons in cylinder bores of a cylinder block, a high pressure gas supply passageway fluidly communicating between the discharge chamber and the crank chamber so as to supply the crank chamber with a high pressure gas, a flow choke arranged adjacent to the high pressure gas supply passageway so as to regulate the pressure and flow rate of the high pressure gas flowing through the gas supply passageway, and a control valve unit for controlling extraction of the high pressure gas from the crank chamber toward the suction chamber in response to a refrigerating load. The high pressure gas supply passageway is formed in the cylinder block, and the flow choke is provided in a discharge valve assembly including a valve plate, a discharge valve element, and a valve retainer.

8 Claims, 3 Drawing Sheets

VARIABLE CAPACITY SWASH-PLATE TYPE COMPRESSOR WITH AN IMPROVED CAPACITY CONTROL MEANS

BACKGROUND OF THE INVENTION

1. The Field of the Invention

The present invention relates to a multi-piston variable capacity swash-plate type compressor of the type wherein the volume of a compressed refrigerant gas discharged from a discharge chamber is changed by varying tile angle of inclination of a swash-plate rotating in a crank chamber about an axis of rotation of a drive shaft through adjustably changing the pressure in the crank chamber, and more particularly, to a mechanical improvement to an internal capacity control means of a variable capacity swash-plate type compressor adapted for use in a refrigerating or an airconditioning system of an automobile.

2. Description of the Related Art

U.S. Pat. No. 3,861,829 granted to Robert et al discloses a typical variable capacity swash-plate type compressor suitable for being incorporated in an airconditioning system of an automobile. The disclosed compressor of U.S. Pat. No. 3,861,829, is provided with a crank chamber in which a swash-plate mechanism for driving reciprocation of a plurality of compressor-pistons rotates with a drive shaft about an axis of rotation of the drive shaft, and the compressor-pistons reciprocating in respective compression chambers compress a refrigerant gas sucked into the compression chambers from a suction chamber and discharge the compressed gas from the compression chambers towards a discharge chamber. The discharge capacity of the compressor is varied by adjustably changing an angle of inclination of the swash-plate with respect to a plane perpendicular to the axis of rotation of the drive shaft to thereby change the reciprocating stroke of the compressor-pistons. The angle of inclination of the swash-plate is adjustably changed by controlling the pressure acting on the rear faces of the respective pistons with respective to the pressure in the suction chamber, and the control of the pressure differential between the pressure in the crank chamber supplied by blow-by gas from the compression chambers and that in the suction chamber is achieved by removing the blow-by gas from the crank chamber toward the suction gas circuit in the compressor in response to a detection of the abovementioned pressure differential.

Nevertheless, according to recent demand for a low-weight refrigerant compressor, the cylinder block and the pistons of a swash-plate type refrigerant compressor for an automobile refrigerating system are made of aluminum alloy. Further, the sealing between the pistons and the wall of the cylinder bores of the cylinder block is usually achieved by piston rings in the form of seamless rings made of synthetic material such as tetrafluoroethylene. The sealing property of the tetrafluoroethylene is, however, generally unstable, and therefore, the resin-piston rings deteriorate in time. Thus, during a long period of operation of the compressor, the amount of the blow-by gas flowing from the cylinder bores into the crank chamber tends to gradually increase due to deterioration of the sealing property of the resin-piston rings.

In order to eliminate the above-mentioned defect encountered by the conventional low-weight swash-plate type refrigerant compressor, Japanese Unexamined (Kokai) Patent Publication No. 1-142277 discloses an improved variable-capacity multi-piston type refrigerant compressor provided with a cylinder block having a plurality of cylinder bores, a suction chamber for refrigerant gas before compression, a discharge chamber for compressed refrigerant gas, a crank case having a crank chamber for receiving a rotatable swash-plate mechanism driving reciprocatory pistons in the cylinder bores, and a capacity control means having a supply means for stably supplying the crank chamber with a constant amount of high pressure gas to thereby accurately control the pressure in the crank chamber. Namely, the capacity control means of the compressor of Japanese Unexamined (Kokai) Patent Publication No. 1-142277 is provided with a through-hole means formed in the cylinder block so as to function as a throttle or choke arranged in a communicating passageway running from the discharge chamber toward the crank chamber. More specifically, the communicating passageway is formed as a stepwise through-bore piercing through the cylinder block and having a large diameter bore portion and a small diameter bore portion. The small diameter portion of the through-bore or a capillary tube fitted in the small diameter portion is used for constituting the throttle.

Nevertheless, the formation of the stepwise through-bore by the drilling method often results in residue of a certain amount of burr which is very difficult to remove. Moreover, since the formation of the through-bore having a diameter of, at most, 0.3 mm to 0.5 mm in the cylinder block made of aluminum alloy demands the use of a small diameter drill, a cutting chip of aluminum alloy in the form of a spiral sticks to the cutting edge of the drill. Accordingly, the accuracy of drilling of a small diameter through-bore is lowered and the production rate is also lowered.

Another proposal for improving the capacity control of a variable capacity swash-plate type refrigerant compressor has been known, in which a pin element having an orifice therein is arranged so as to project from a valve plate toward a discharge chamber in order to provide a throttle or choke in a communicating passage between the crank chamber and the discharge chamber. Nevertheless, the arrangement of the pin element projecting toward the discharge chamber brings about such a defect that since the flow rate of the compressed refrigerant gas starting from the discharge chamber and flowing through the primary refrigerating circuit is larger than that of the gas flowing from the discharge chamber into the crank chamber via the orifice of the pin element, a lubricant suspended in the refrigerant gas is carried by the compressed refrigerant gas flowing through the primary refrigerating circuit and accordingly, a sufficient amount of lubricant cannot be supplied into the crank chamber through the orifice of the pin element. Accordingly, the rotating elements of the rotating swash-plate mechanism in the crank chamber might not be adequately lubricated due to lack of lubricant.

SUMMARY OF THE INVENTION

Therefore, an object of the present invention is to provide a variable capacity swash-plate type refrigerant compressor provided with an improved capacity control means including a gas supply passageway means capable of stably supplying a crank chamber with a constant amount of high pressure gas throughout the operating life of the compressor without causing any difficulty in the manufacture of the supply passageway means and without reducing lubrication to the moving elements in the crank chamber.

Another object of the present invention is to provide an improved capacity control means capable of being applied to even a low-weight variable capacity swash-plate type refrigerant compressor made of non ferric material such as aluminum alloy.

In accordance with the present invention, there is provided a variable capacity swash-plate type refrigerant compressor which comprises:

an axial cylinder block unit having front and rear ends, and a plurality of parallel cylinder bores arranged around a central axis thereof;

a front housing unit airtightly attached to the front end of the cylinder block and defining therein a crank chamber;

a rear housing unit airtightly attached to the rear end of the cylinder block via a valve plate and defining therein a suction chamber for a refrigerant gas before compression and a discharge chamber for a compressed refrigerant gas;

a discharge valve assembly arranged between the rear end of the cylinder block and the rear housing, the discharge valve assembly including the valve plate, a discharge valve element arranged so as to be in contact with the valve plate and a valve retainer element diposed in the discharge chamber so as to support the discharge valve element;

an axial drive shaft rotatably held by the front housing unit and the cylinder block unit and having an axis of rotation thereof extending through the crank chamber;

a swash-plate assembly rotatably arranged in the crank chamber and rotating with the drive shaft, the swash-plate assembly being pivotally held by the drive shaft so as to be able to change an angle of inclination thereof with respect to a plane perpendicular to the axis of rotation of the drive shaft;

a plurality of reciprocatory pistons operatively connected to the swash-plate and reciprocating in the plurality of cylinder bores in response to nutating motion of the swash-plate; and a capacity control unit including a control valve unit controlling a pressure differential between a pressure prevailing in the crank chamber and that prevailing in the suction chamber so as to adjustably change the angle of inclination of the swash-plate to thereby vary the discharge capacity of the compressed refrigerant gas of the compressor, wherein the capacity control unit further comprises:

a fluid supply passageway arranged so as to pierce through a portion of the cylinder block to thereby provide a constant fluid communication between the discharge chamber and the crank chamber; and, a flow choke means provided in the discharge valve assembly and arranged so as to be in direct communication with the fluid supply passageway.

Preferably, the flow choke means is formed by a through-hole having a diameter appreciably smaller than a diameter of the fluid supply passageway. The through-hole may be formed in at least one of the valve plate, and the assembly of the discharge valve element and the valve retainer element.

The fluid supply passageway formed in the cylinder block can be a mere through-bore having a large diameter and easily bored by a is drilling tool without generating of burr around the through-hole.

Further, since the discharge valve element or the valve retainer element of the discharge valve assembly are made of a thin plate member, respectively, the choke-forming through-bore formed in the discharge valve assembly can be also easily formed by using a drilling tool. Moreover, particles of lubricant oil attached to the discharge valve assembly within the discharge chamber can easily flow toward the crank chamber through the fluid supply passageway having a large diameter. Thus, the movable elements in the crank chamber can be supplied with a sufficient amount of lubricant oil.

DESCRIPTION OF PREFERRED EMBODIMENTS

Figure 1:
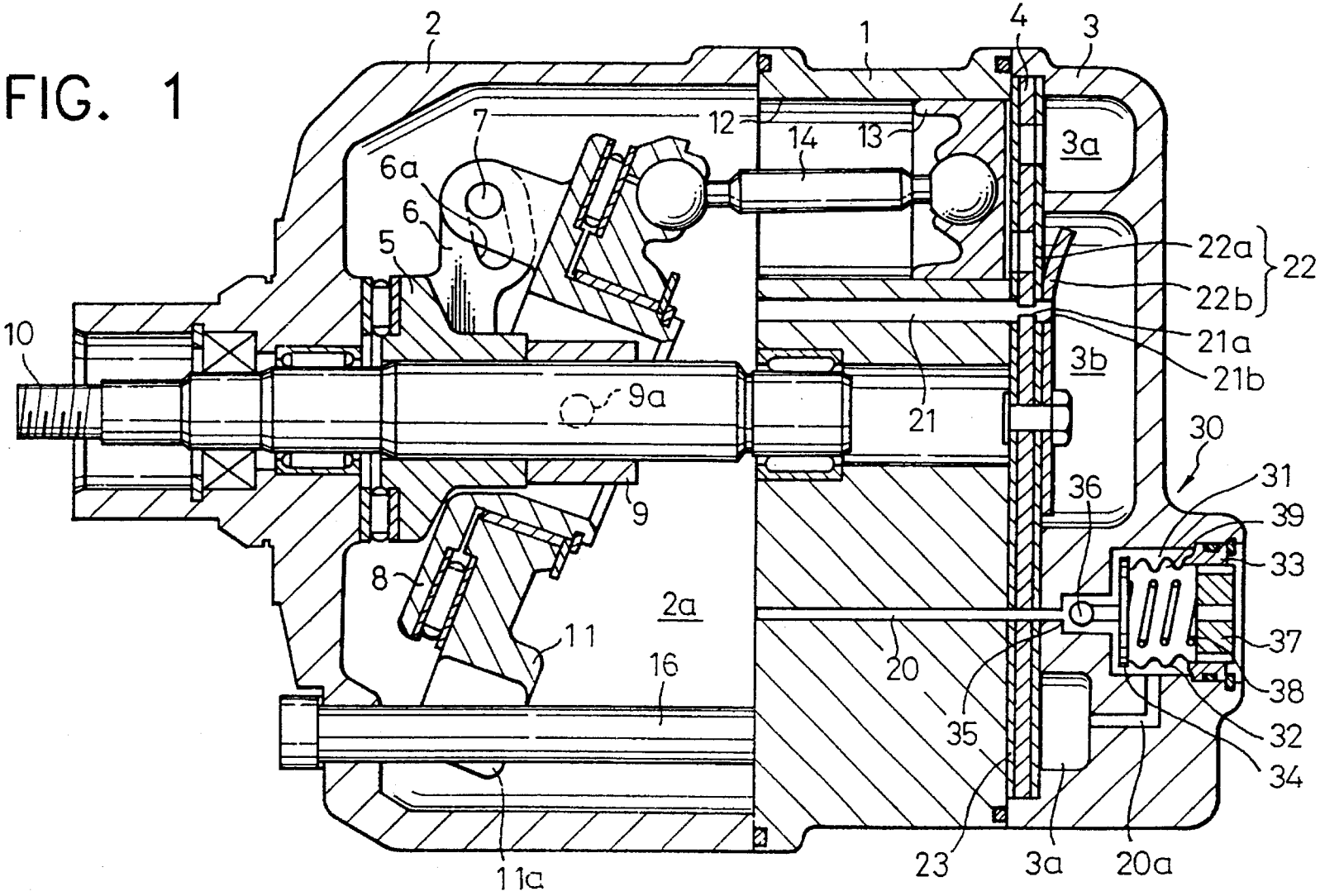
FIG. 1 is a longitudinal cross-sectional view of a variable capacity swash-plate type refrigerant compressor provided with an internal capacity control means according to an embodiment of the present invention.

Referring to FIG. 1, a variable capacity swash-plate type refrigerant compressor is provided with a cylinder block 1 forming a part of an outer frame of the compressor and having a plurality of axially extending cylinder bores 12 arranged around a central axis of the cylinder block. The compressor is further provided with a front housing 2 airtightly attached to a front end of the cylinder block 1, and a rear housing 3 airtightly attached to a rear end of the cylinder block 1. The front housing 2 has a crank chamber **2*a* formed therein and extending in front of the front end of the cylinder block 1. The rear housing 3 has an outer suction chamber 3*a* for receiving a refrigerant gas before compression and an inner discharge chamber 3*b* for receiving a refrigerant gas after compression, formed therein respectively. The suction chamber 3*a* and the discharge chamber 3*b* are fluidly isolated from one another. A valve plate 4 is disposed between the rear end of the cylinder block 1 and the open end of the rear housing 3, and is provided with an inner face to which a suction valve element 23 in the form of a flexible sheet is attached, and an outer face to which a later-described discharge valve element 22*a*** is attached.

An axial drive shaft 10 is rotatably held by the cylinder block 1 and the front housing 2 via rotary bearing elements, and has an axis of rotation extending axially in the crank chamber **2*a*. A frontmost end of the drive shaft 10 is extended beyond the frontmost end of the front housing 2** so as to receive a drive force from an exterior drive source such as an automobile engine.

The drive shaft 10 is provided with a drive element 5 mounted thereon at a position adjacent to an inner end of the front housing 2, and axially supported by a thrust bearing seated against the inner end of the front housing 2. The drive element 5 is provided with a support arm 6 extending rearwardly, and having an elongated hole 6a formed therein. A slide pin 7 is movably fitted in the elongated hole 6a of the support arm 6, and the slide pin 7 is pivotally connected to a rotatable swash-plate 8 arranged in such a manner that the swash-plate 8 is able to rotate around the drive shaft 10 together with the drive element 5 and the drive shaft 10. The swash-plate is also able to move so as to change an angle of inclination with respect to a plane perpendicularly to the axis of rotation of the drive shaft 10.

A cylindrical sleeve element 9 is slidably mounted on the drive shaft 10 at a position adjacent to an inner end of the drive element 5 within the crank chamber 2a. The sleeve element 9 is provided with a pair of lateral pins 9a (one of them is shown in FIG. 1 ) which project laterally into the crank chamber 2a. The lateral pins 9a pivotally support the swash-plate 8 so that the swash-plate 8 may turn about the pins 9a when the inclination angle thereof changes. The swash-plate 8 supports a wobble plate 11 thereon via journal and thrust bearings, and permits the wobble plate 11 to change its angle of inclination together with the swash-plate 8. Namely, the wobble plate 11 does not rotate about the axis of rotation of the drive shaft 10. The wobble plate 11 is provided with a slide guide portion 11a at a portion of the outer circumference thereof which portion is engaged with a long bolt member 16 axially extending through the crank chamber 2a. Thus, the wobble plate 11 is prevented from being rotated, and accordingly, the wobble plate 11 performs a nutating motion, together with the swash-plate 11, around the drive shaft 10.

The wobble plate 11 is operatively connected to a plurality of pistons 13 via corresponding connecting rods 14, and therefore, the pistons 13 perform a reciprocating motion in the axial cylinder bores 12 in response to the nutating motion of the swash and wobble plates 8 and 11. Namely, the rotation of the drive shaft 10 is converted into the nutating motion of the swash and wobble plates 8 and 11, and thus, the reciprocation of the pistons 13 is caused by the nutation of the wobble plate 11. The reciprocation of the pistons 13 in the cylinder bores 12 causes a suction of the refrigerant gas from the suction chamber 3a into the respective cylinder bores 12 as well as a compression of the refrigerant gas within the cylinder bores 12. The compressed refrigerant gas is discharged from the cylinder bores 12 into the discharge chamber 3b by the pistons 13 while the pistons 13 are moving toward the top dead center thereof within the cylinder bores 12.

At this stage, the angle of inclination of the swash and wobble plates 8 and 11 is changed in response to a pressure differential between a pressure prevailing in the crank chamber 2a and that prevailing in the suction chamber 3a, and the change in the inclination angle of the wobble plate 11 causes a change in the reciprocating stroke of respective pistons 13, and accordingly, the capacity of compressed refrigerant gas discharged from the respective cylinder bores 12, and in turn the amount of delivery of the compressed refrigerant gas from the compressor toward the exterior refrigerating circuit is varied. The control of the discharged volume of the compressed refrigerant gas is achieved by adjustably changing the angle of inclination of the swash and wobble plates 8 and 11 through controlling of the afore-mentioned pressure differential. The pressure differential is controlled by adjustably changing the pressure level in the crank chamber 2a by the use of a control valve unit 30 in response to a change in a refrigerating load applied to the compressor. The control valve unit 30 is housed in the rear housing 3.

In order to control the pressure level in the crank chamber 2a, there is provided an axial fluid passageway 20 formed so as to extend through the cylinder block 1, the valve plate 4, and the rear housing 3 to thereby obtain a fluid communication between the suction chamber 3a and the crank chamber 2a. An end of the axial fluid passageway 20 is communicated with a valve chamber 31 formed in the rear housing 3 so as to be coaxial and in registration with the fluid passageway 20 The valve chamber 31 opens toward outside the rear housing 3 and houses therein bellows 32 having an outer end connected to a support ring 33 fixedly fitted in the entrance of the valve chamber 31.

The bellows 32 is connected to a front sealing plate 34 to which an axially movable spherical valve element 36 having a valve rod is attached so as to open or close a valve port 35 formed at the connecting portion of the axial fluid passageway 20 and the valve chamber 31. A control spring 38 is arranged in the bellows 32 between the front sealing plate 34 and a spring seat 37 threadedly engaged in an threaded bore of the support ring 33. The control spring 38 applies a spring force to the front sealing plate 34 thereby to constantly urge the spherical valve element 36 toward a position closing the valve port 35. The spring seat 37 is provided with a through-hole which communicates the interior chamber 39 of the bellows 32 with the outer atmosphere. An annular portion in the valve chamber 31 surrounding the bellows 32 is communicated with the suction chamber 3a via a fluid passageway 20a arranged therebetween, and functions as a pressure sensing chamber applying a suction pressure to the bellows 32 which acts against the spring force of the spring 38 and the atmospheric pressure.

As is understood from the foregoing, the control valve unit 30 is constituted by the bellows 32, the support ring 33, the front sealing plate 34, the spherical valve element 36, the spring seat 37, and the biasing spring 38.

When the compressor is driven by an external drive force from, for example, an automobile engine, via a non-illustrated solenoid clutch, a pressure prevailing in the annular portion of the valve chamber 31, i.e., the pressure sensitive chamber communicating with the suction chamber 3a via the fluid passageway 20a, externally acts on the bellows 32 so as to oppose against the force of the biasing spring 38 and the atmospheric pressure internally acting on the bellows 32 , and controls the opening degree of the valve port 35 of the fluid passageway 20 by the movement of the spherical valve element 36 in cooperation of the supply of a high pressure gas (the compressed refrigerant gas) toward the crank chamber 2a via a later-described fluid supply passageway 21 formed in the cylinder block 1. Thus, during operation, the pressure level prevailing in the crank chamber 2a changes in compliance with a change in a refrigerating load applied to the compressor. The change in the pressure level in the crank chamber 2a causes a change in the inclination angle of the swash and wobble plates 8 and 11, and in turn changes the stroke of the pistons 13 so as to adjustably vary the discharge capacity of the variable capacity swash-plate type compressor.

The fluid supply passageway 21 for supplying the crank chamber 2a with a high pressure gas from the discharge chamber 3b is provided in the cylinder block 1 in the form of a through-bore axially piercing through the cylinder block 1 and having an appreciably large diameter. Namely, the fluid supply passageway 21 is arranged so as to establish a constant fluid communication between the discharge chamber 3b and the crank chamber 2a. The position of the fluid supply passageway 21 is chosen such that the fluid supply passageway 21 has one end opening toward the crank chamber 2a and the other end opening toward the discharge chamber 3b. In the discharge chamber 3b, a discharge valve assembly 22 including the discharge valve element 22*a* in the form of a flexible reed valve, and the valve retainer element 22*b* is fixedly attached to the rear end face of the valve plate 4.

Figure 3:
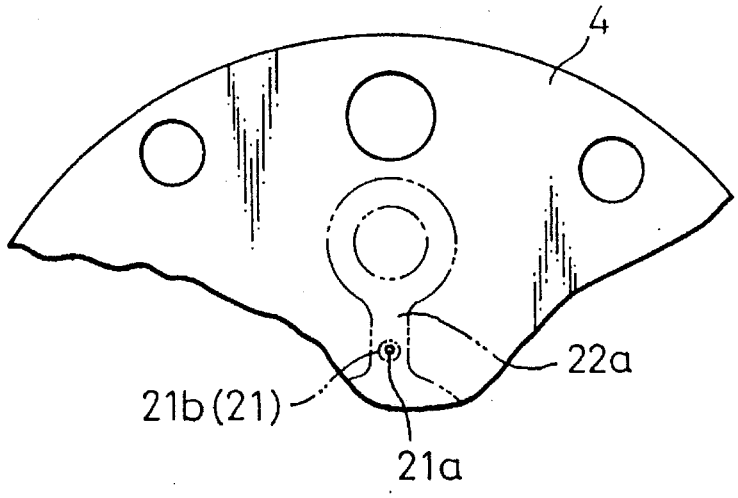
FIG. 3 is a partially cut front view of a valve plate suitable for being accommodated in a variable capacity swash-plate type refrigerant compressor, illustrating a choke-forming hole formed in the valve plate.

In the arrangement of FIG. 1, the fluid supply passageway 21 includes a passageway portion concentrically piercing through the valve plate 4, the discharge valve element 22*a*, and the valve retainer element 22*b*. Nevertheless, the fluid supply passageway 21 is internally provided with a choke portion 21*a* formed in the valve plate 4 so as to be arranged between a portion of the fluid supply passageway 21 formed in the cylinder block 1 and a portion 21*b* of the fluid supply passageway 21 formed in the valve assembly. As best shown in FIG. 3, the choke portion 21*a* of the valve plate 4 has a predetermined small diameter, and acts as a fluid-flow throttling means which is able to regulate pressure and flow rate of the gas flowing through the fluid supply passageway 21 at a required constant level, respectively. Namely, the pressure level of the high pressure gas (the compressed refrigerant gas) is reduced by the choke portion 21*a* to an appropriate level before flowing into the crank chamber 2*a* via the fluid supply passageway 21, and also the flow rate of the high pressure gas is regulated at a constant speed level by the choke portion 21*a*. Thus, the amount of the high pressure gas entering the crank chamber 2*a* can be constant. The high pressure gas entering the crank chamber 2*a* changes a pressure level within the crank chamber 2*a* in association with extraction of the gas from the crank chamber 2*a* via the fluid passageway 20 controlled by the control valve unit 30. Thus, the control of the discharge capacity of the compressor can be achieved due to the change in the inclination angle of the swash and wobble plates 8 and 11.

At this stage, it should be appreciated that, since the choke portion 21*a* of the fluid supply passageway communicating between the discharge chamber 3*b* and the crank chamber 2*a* is formed in the thin valve plate 4, the formation of the small diameter choke portion 21*a* is very easy. In addition, the long fluid supply passageway 21 formed in the cylinder block 1 can be formed in a straight or linear through-hole having an appreciably large diameter and bored by a conventional drilling tool, and, accordingly, the formation of the fluid supply passageway 21 can be very easy. Further, during the formation of the fluid supply passageway 21, no cutting burr is generated. Even if a slight amount of cutting burr appears at the opposite ends of the fluid passageway 21, the burr can be easily removed by the drilling tool.

In accordance with the above-mentioned arrangement of the fluid supply passageway 21 provided with the choke portion 21*a*, the flow of the high pressure gas is able to easily enter the fluid passageway particles of the lubricant oil attached to the discharge valve assembly 22 is positively carried by the flow of the high pressure gas from the discharge chamber 3*b* toward the crank chamber 2*a*. Therefore, the interior of the crank chamber 2*a* can be constantly supplied with a sufficient amount of the lubricant oil.

Figure 2:
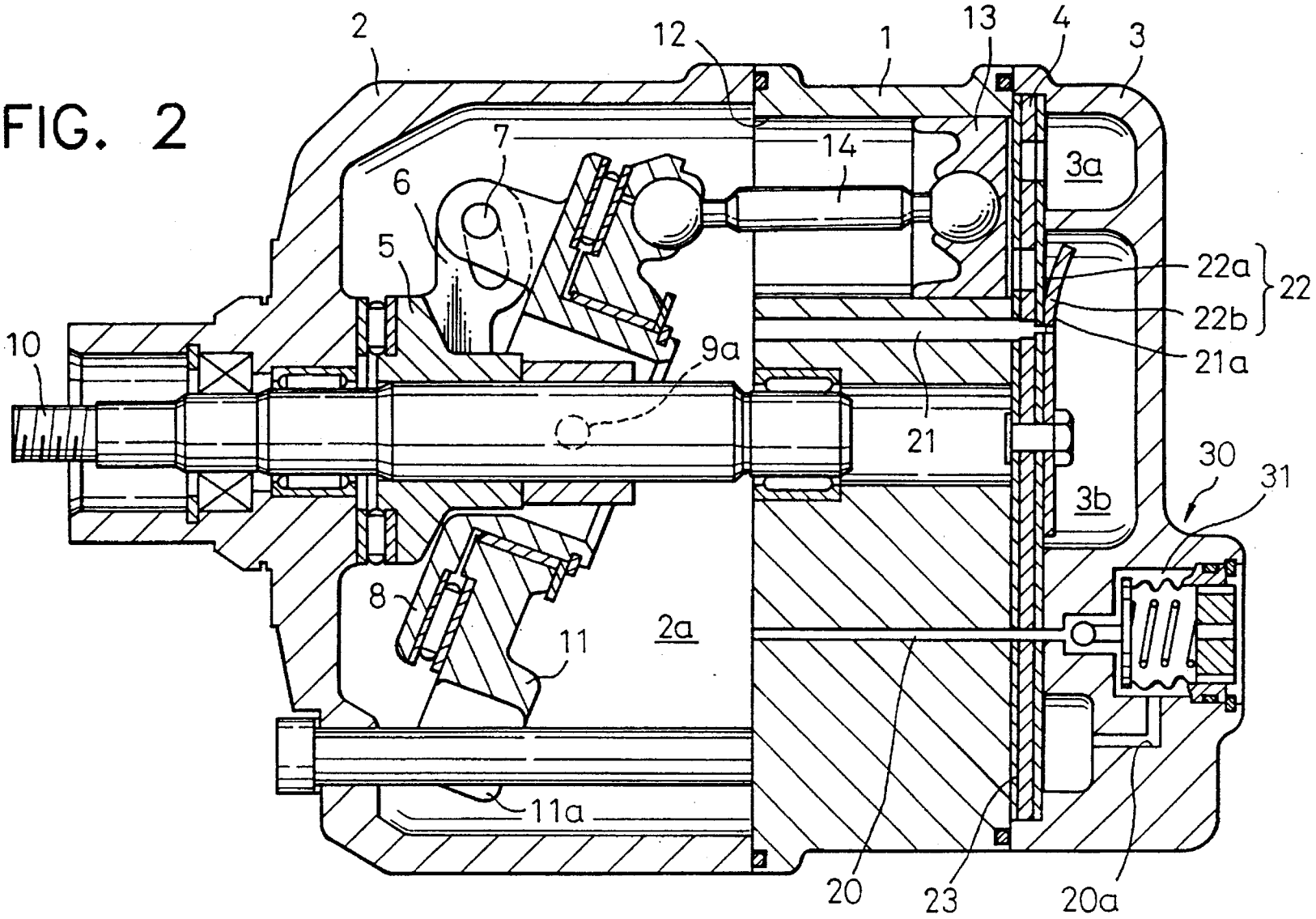
FIG. 2 is a longitudinal cross-sectional view of a variable capacity swash-plate type refrigerant compressor according to another embodiment of the present invention.

FIG. 2 illustrates a different embodiment of the present invention in which the choke portion 21*a* of the fluid supply passageway 21 is formed in the discharge valve element 22*a* and the valve retainer element 22*b*. The other construction of the compressor of FIG. 2 is the same as that of the aforementioned embodiment of FIGS. 1 and 3.

It should be understood that the position of the fluid supply passageway 21 is not limited to the illustrated embodiments of FIGS. 1 through 3. For example, the fluid supply passageway 21 may extend so as to pass through only the valve plate 4 but not to pass through the discharge valve assembly 22.

Figure 4:
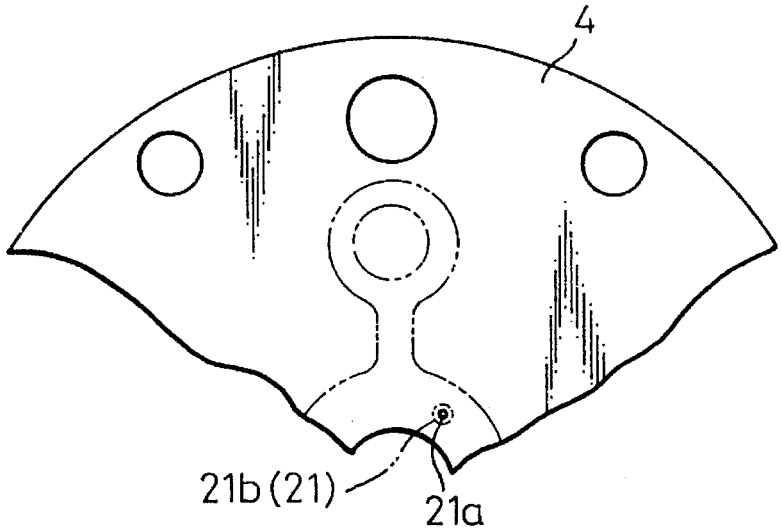
FIG. 4 is a partially cut front view of another valve plate, illustrating a choke-forming hole formed in the valve plate at a position different from the position of the choke-forming hole of FIG. 3.

FIG. 4 illustrates a different arrangement of the choke portion 21*a*. Namely, the choke portion 21*a* coaxial with the fluid supply passageway 21 (21*b*) is arranged at a position at an annular base portion of the discharge valve element 22*a*. The operation of the choke portion 2*a* can be, of course, the same as that of FIG. 3.

Figure 5:
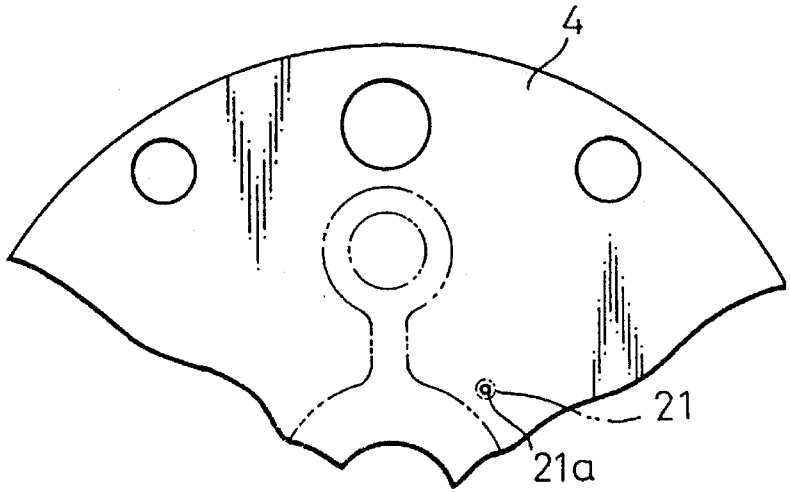
FIG. 5 is a partially cut front view of a further valve plate, illustrating a choke-forming hole formed in the valve plate at a position different from the position of the choke-forming hole of FIG. 3.

In the embodiment of FIG. 5, the choke portion 21*a* coaxial with the fluid supply passageway 21 is located in a portion of the valve plate 4 distant from the discharge valve assembly 22.

From the foregoing description of the embodiments of the present invention, it will be understood that the variable capacity swash-plate type refrigerant compressor is provided with a mechanically improved capacity control unit capable of stably and constantly supplying a high pressure gas to the crank chamber to thereby accurately control the pressure level in the crank chamber in association with a control valve controlling extraction of the gas from the crank chamber toward the suction chamber in response to a change in a refrigerating load applied to the compressor. Furthermore, tile high pressure gas supply passageway can be provided with a choke portion formed in the thin discharge valve assembly and controlling the pressure and the flow rate of the high pressure gas to be supplied to the crank chamber. Thus, the formation of the fluid supply passageway for supplying the high pressure gas can be easily manufactured by the employment of a conventional drilling tool. Thus, the manufacturing of the capacity control unit can be achieved at a high production rate and a low manufacturing cost.

Moreover, in accordance with the present invention, a constant supply of a sufficient amount of lubricant oil from the discharge chamber toward the crank chamber can be ensured.

It should be understood that many variations and modifications to the illustrated embodiments of the present invention will occur to persons skilled in the art without departing from the scope and spirit of the present invention claimed in the accompanying claims.

We claim:

1. A variable capacity swash-type refrigerant compressor comprising:

an axial cylinder block means having front and rear ends, and a plurality of parallel cylinder bores arranged around a central axis thereof;

a front housing means airtightly attached to said front end of said cylinder block and defining a crank chamber therein;

a rear housing airtightly attached to said rear end of said cylinder block via a valve plate and defining therein a suction chamber for a refrigerant gas before compression and a discharge chamber for a compressed refrigerant gas;

a suction valve assembly arranged for communication between said cylinder bore and said suction chamber;

a discharge valve assembly arranged between said rear end of said cylinder block and said rear housing, said discharge valve assembly including said valve plate, a discharge valve element arranged so as to be in contact with said valve plate and a valve retainer element disposed in said discharge chamber so as to support said discharge valve element;

an axial drive shaft rotatably held by said front housing means and said cylinder block means, and having an axis of rotation thereof extending through said crank chamber;

a swash-plate means rotatably arranged in said crank chamber and rotating with said drive shaft, said swash-plate means being pivotally held by said drive shaft so as to be able to change an angle of inclination thereof with respect to a plane perpendicular to the axis of rotation of said drive shaft;

a plurality of reciprocatory pistons operatively connected to said swash-plate means and reciprocating in said plurality of cylinder bores in response to a nutating motion of said swash-plate means; and a capacity control means including a control valve unit controlling a pressure differential between a pressure prevailing in said crank chamber and that prevailing in said suction chamber so as to adjustably change the angle of inclination of said swash-plate to thereby vary the discharge capacity of said compressed refrigerant gas of said compressor, wherein said capacity control means further comprises:

a single diameter fluid passageway arranged so as to axially pierce a portion of said cylinder block to thereby provide a constant fluid communication between said discharge chamber and said crank chamber; and a flow choke means provided in said discharge valve assembly, said flow choke means being arranged at a position in direct communication with said fluid supply passageway.

2. A variable capacity swash-plate type refrigerant compressor according to claim 1, wherein said flow choke means is formed by a through-hole having a diameter smaller than a diameter of said fluid supply passageway.

3. A variable capacity swash-plate type refrigerant compressor according to claim 2, wherein said through-hole of said flow choke means is formed in at least one of said valve plate, said assembly of said discharge valve element and said valve retainer element.

4. A variable capacity swash-plate type refrigerant compressor according to claim 2, wherein said through-hole of said flow choke means is arranged to be concentric with said fluid supply passageway formed in said cylinder block.

5. A variable capacity swash-plate type refrigerant compressor according to claim 1, wherein said fluid supply passageway formed in said cylinder block comprises an axial and linear through-bore bored by a drilling tool.

6. The variable capacity swash-plate type refrigerant compressor of claim 5 wherein the-flow choke means provided in said discharge valve assembly comprises a hole having a diameter smaller than the diameter of the fluid supply passageway.

7. A variable capacity swash-plate type refrigerant compressor according to claim 6, wherein said through-hole of said flow choke means is formed in at least one of said valve plate, said assembly of said discharge valve element and said valve retainer element.

8. A variable capacity swash-plate type refrigerant compressor according to claim 5, wherein said through-hole of said flow choke means is arranged to be concentric with said fluid supply passageway formed in said cylinder block.

* * * * *